United States Patent [19]

Ogita

[11] 4,216,749

[45] Aug. 12, 1980

[54] IGNITION TIMING CONTROL DEVICE

[75] Inventor: Tamotsu Ogita, Susono, Japan

[73] Assignee: Toyota Jidosha Kogyo Kabushiki Kaisha, Toyota, Japan

[21] Appl. No.: 702

[22] Filed: Jan. 3, 1979

[30] Foreign Application Priority Data

Jan. 13, 1978 [JP] Japan ..... 53-2432

[51] Int. Cl.[2] ..... F02P 5/10

[52] U.S. Cl. ..... 123/408; 123/410

[58] Field of Search ..... 123/117 A, 117 R, 146.5 A

[56] References Cited

U.S. PATENT DOCUMENTS

| | | | |
|---|---|---|---|
| 3,521,609 | 7/1970 | Kashiwagi et al. | 123/117 A |
| 3,561,411 | 2/1971 | Vasilescu et al. | 123/117 A |
| 3,828,743 | 8/1974 | Ludwig | 123/117 A |
| 3,948,232 | 4/1976 | Gould et al. | 123/117 A |
| 4,095,568 | 6/1978 | Furukawa | 123/117 A |
| 4,151,818 | 5/1979 | Tateno | 123/117 A |

*Primary Examiner*—Charles J. Myhre
*Assistant Examiner*—Andrew M. Dolinar
*Attorney, Agent, or Firm*—Finnegan, Henderson, Farabow, Garrett & Dunner

[57] ABSTRACT

An ignition timing control device having first and second systems for advancing ignition timing by vacuum, wherein the first system operates with an advancer port so as to effect vacuum advancing when the throttle valve is opened beyond the advancer port, while the second system operates to provide vacuum advancing of ignition timing in idling operation when the engine is operated at a normal altitude and to provide an additional basic vacuum advancing of ignition timing in idling as well as in power-producing operation when the engine is operated at a high altitude.

5 Claims, 1 Drawing Figure

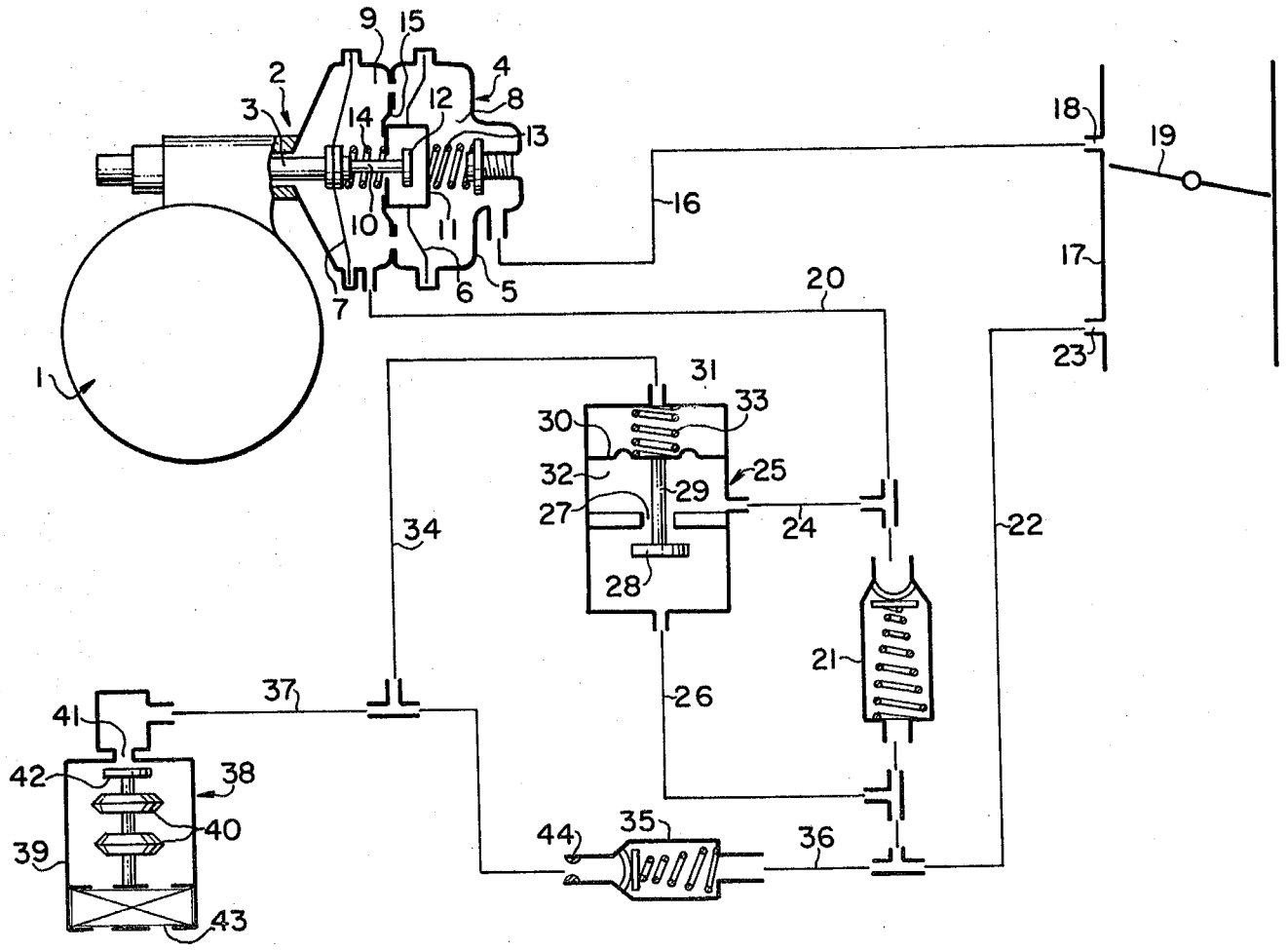
1
2
3
4
5
6
7
8
9
10
11
12
13
14
15
16
17
18
19
20
21
22
23
24
25
26
27
28
29
30
31
32
33
34
35
36
37
38
39
40
41
42
43
44

IGNITION TIMING CONTROL DEVICE

BACKGROUND OF THE INVENTION

The present invention relates to an ignition timing control device in an internal combustion engine for automobiles.

In an internal combustion engine the combustion speed of fuel-air mixture in the cylinder chamber of the engine lowers as the throttle valve is closed so as to reduce the amount of fuel-air mixture introduced into the cylinder chamber. In view of this an internal combustion engine generally employs a vacuum advancer which advances ignition timing in accordance with the intensity of the vacuum in the intake passage of the engine.

The vacuum advancer generally comprises a diaphragm means and a mechanism adapted to be driven by said diaphragm means so as to advance ignition timing when vacuum is supplied to the diaphragm chamber of the diaphragm means. The diaphragm chamber is generally connected with a vacuum port provided in the intake passage of the engine, said intake passage incorporating a throttle valve and supplying fuel-air mixture to the cylinder chambers, the vacuum port being positioned at the upstream side of the throttle valve when it is substantially closed so as to effect idling operation of the engine and being positioned at the downstream side of the throttle valve when it is opened beyond a predetermined opening. Such a vacuum port is generally called an advancer port. In this conventional vacuum advancer, therefore, no vacuum advancing of ignition timing is effected in idling operation, and only when the throttle valve is opened beyond a predetermined opening so as to operate the engine in an at least partially loaded condition is the vacuum advancer put into operation so as to advance ignition timing in accordance with the intensity of the vacuum generated in the intake passage. A substantial advance of ignition timing by the vacuum advancer is effected so far as the throttle valve is opened up to approximately three fourths of full opening, and when the throttle valve is opened beyond this limit, the vacuum advancing of ignition timing is substantially reduced to zero because in this case the vacuum port is substantially exposed to atmospheric pressure.

A conventional vacuum advancer of the abovementioned structure provides a satisfactory vacuum advancing performance of ignition timing in conventional internal combustion engines which incorporate no exhaust gas purifying system. However, in a modern automobile engine which incorporates an exhaust gas purifying system and operates at a relatively high rotational speed even in idling operation, it is desirable that a certain degree of vacuum advancing of ignition timing should be effected even in idling operation, because by this arrangement it is possible to increase the power output of the engine per unit amount of fuel, and therefore it is possible to improve fuel consumption in idling operation.

Further, it is known that when an automobile is driven at high altitude, power output of the engine lowers due to a reduction in the charging efficiency of the engine caused by lowering of atmospheric pressure, while the knock limit advantageously increases, so that in high altitude operation it is possible to advance ignition timing by an additional amount without causing knocking of the engine. Therefore it is contemplated that by incorporating such an additional advance of ignition timing in high altitude operation it is possible to compensate for the reduction of output power due to lowering of atmospheric pressure.

SUMMARY OF THE INVENTION

In view of the abovementioned two aspects of advancing of ignition timing in an internal combustion engine, it is the object of the present invention to provide an improved ignition timing control device which provides vacuum advancing of ignition timing in accordance with the intensity of intake vacuum as well as a basic idling vacuum advance of ignition timing and which also provides an additional advance of ignition timing in high altitude operation of the engine.

In accordance with the present invention, the abovementioned object is accomplished by an ignition timing control device in an engine having an intake passage and a throttle valve provided in said intake passage, comprising a vacuum advancer having first and second diaphragm chambers and adapted to advance ignition timing when at least one of said diaphragm chambers is supplied with vacuum, a first vacuum port which is positioned at the upstream side of the throttle valve when it is substantially closed so as to effect idling operation of the engine and which is positioned at the downstream side of the throttle valve when it is opened beyond a predetermined opening, a second vacuum port constantly positioned at the downstream side of the throttle valve, a first passage means which connects said first vacuum port and said first diaphragm chamber, a second passage means which connects said second vacuum port and said second diaphragm chamber, a check valve provided in said second passage means and adapted to allow fluid to flow only from said second diaphragm chamber towards said second vacuum port, an ON/OFF valve provided in said second passage means in parallel with said check valve, and a barometric control means which controls said ON/OFF valve so as to open said ON/OFF valve when atmospheric pressure is at or above a predetermined value and so as to close said ON/OFF valve when atmospheric pressure is below the predetermined value.

BRIEF DESCRIPTION OF THE DRAWING

The present invention will become more fully understood from the detailed description given hereinbelow and the accompanying drawing, which is given by way of illustration only, and is thus not limitative of the present invention, and wherein the sole FIGURE is a diagrammatical illustration of an embodiment of the ignition timing control device according to the present invention.

Referring to the drawing, 1 designates a distributor which itself is well known in the art and which includes breaker plates, points, etc., not shown in the FIGURE and which is operationally connected with a vacuum advancer 2. The vacuum advancer comprises an advancing rod 3 which is operationally connected with said breaker plates and is adapted to effect advancing of ignition timing when it is shifted rightward in the FIGURE. The advancing rod 3 is driven by a double diaphragm means 4, which comprises a casing 5 and first and second diaphragms 6 and 7 mounted in said casing as spaced from each other so as to define first and second diaphragm chambers 8 and 9 on their right sides as seen in the FIGURE, respectively. The left side chamber of the second diaphragm 7 as seen in the FIGURE is opened to the atmosphere. The second diaphragm 7 is firmly connected with the advancing rod 3, while on the other hand the first diaphragm 6 is loosely connected with the advancing rod 3 by means of a connecting rod 10 having a flange portion 12 and a box member 11 so as to allow for a predetermined relative axial shifting therebetween. The first diaphragm 6 is resiliently driven leftward in the FIGURE by a first compression coil spring 13 which, in the shown embodiment, engages the box member 11 so that, when no substantial vacuum is introduced into the first diaphragm chamber 8, the first diaphragm 6 is shifted leftward in the FIGURE until the box member 11 engages a stopper portion 15 provided between the first and second diaphragms 6 and 7. Between the first and second diaphragms 6 and 7, i.e., in the shown embodiment, between the box member 11 and the head portion of the advancing rod 3, is mounted a second compression coil spring 14 so as resiliently to drive the second diaphragm 7 leftward in the FIGURE relative to the first diaphragm 6. In this case, the spring force of the second compression coil spring 14 is weaker than that of the first compression coil spring 13.

The first diaphragm chamber 8 is connected with a first vacuum port 18 provided to open to the intake passage of a carburetor 17 by way of a passage means 16. The first vacuum port 18 is provided in a position which is at the upstream side of a throttle valve 19 provided in the intake passage of the carburetor when the throttle valve is substantially closed as shown in the FIGURE so as to effect idling operation of the engine and which is at the downstream side of the throttle valve when it is opened beyond a predetermined small opening which effects power-producing operation of the engine. The second diaphragm chamber 9 is connected with a second vacuum port 23 which also opens to the intake passage of the carburetor 17 at the downstream side of the throttle valve 19 regardless of its opening, by way of a passage means 20, a check valve 21, and a passage 22. As apparent from the FIGURE, the check valve 21 is adapted so as to allow fluid to flow only from the second diaphragm chamber 9 towards the second vacuum port 23. The second vacuum chamber 9 is also connected with the second vacuum port 23 by way of the passage 20, a passage 24, an ON/OFF valve 25, a passage 26, and the passage 22 in a manner of bypassing the check valve 21.

The ON/OFF valve 25 has a valve port 27, a valve element 28 which opens or closes the valve port 27, a valve rod 29 which supports the valve element 28 and is in turn supported by a diaphragm 30, first and second chambers 31 and 32 defined on opposite sides of the diaphragm 30, and a compression coil spring 33 which resiliently drives the diaphragm 30 downward in the FIGURE so as to open the valve port 27. The second chamber 32 is connected with the passage 24 and is also selectively connected with the passage 26 when the valve port 27 is opened. The first chamber 31 is connected with the second vacuum port 23 by way of a passage 34, a passage 36 including a check valve 35, and the passage 22 on the one hand, while on the other hand it is also connected with a barometric valve 38 by way of the passage 34 and a passage 37.

The barometric valve 38 has a casing 39, an elastic metal bellows 40 which axially expands as the atmospheric pressure lowers, a valve port 41, a valve element 42 which is supported by said bellows 40 and which opens or closes the valve port 41 in accordance with contraction or expansion of the bellows and ports 43 through which the internal space of the casing 39 is open to the atmosphere. The barometric valve 38 is adapted to respond to the altitude at which the vehicle is operated in such a manner that, when the vehicle is operated on a land of substantially sea level, the bellows 40 is contracted by the atmospheric pressure so that the valve port 41 is opened, and when the vehicle is operated higher than a predetermined altitude the bellows 40 is expanded so that the valve port 41 is closed by the valve element 42. In the passage connecting the valve port 41 and the second vacuum port 23 is provided a throttling element 44, as, for example, incorporated in the housing of the check valve 35, so as to prevent a large amount of air being drawn into the intake passage of the carburetor through the valve port 41 when it is opened.

In operation, when the vehicle is operated below a predetermined altitude, the valve port 41 of the barometric valve 38 is opened as mentioned above, and therefore the chamber 31 of the ON/OFF valve 25 is dominated substantially by atmospheric pressure, even when an intake vacuum is supplied through the second vacuum port 23, the passage 22 and 36, the check valve 35, and the throttling element 44. In this case, therefore, the diaphragm 30 of the ON/OFF valve 25 is driven downward in the FIGURE by the compression coil spring 33, thereby opening the valve port 27, so that the second diaphragm chamber 9 is connected with the second vacuum port 23 through the passages 20 and 24, the open valve port 27, and the passages 26 and 22, in a manner of bypassing the check valve 21, so that the second diaphragm chamber 9 is constantly supplied with the intake vacuum which appears in the second vacuum port 23. In this case, therefore, when the engine is idling, a certain vacuum is supplied to the second vacuum chamber 9 so as to advance ignition timing by a certain degree so that the output power of the engine per unit amount of fuel increases and so that in turn the fuel consumption in idling, particularly in high speed idling as in an engine incorporating exhaust gas recirculation, is improved. The vacuum advancing of ignition timing in this operating condition is effected so far that the flange portion 12 of the connecting rod 10 abuts against the box member 11 which in turn is held as abutting against the stop portion 15. When the throttle valve 19 is opened so far as to traverse the first vacuum port 18, an intake vacuum also appears in the port 18, and this vacuum is supplied to the first diaphragm chamber 8. This first vacuum advancing system consisting of the first vacuum port 18 (advancer port), the passage 16, the first diaphragm chamber 8, and the first diaphragm 6 to which the advancing rod 3 is now firmly connected by the action of vacuum supplied in the second diaphragm chamber 9, i.e. between the first and second diaphragms 6 and 7, operates in the same manner as a conventional vacuum advancing system depending upon an advancer port in accordance with opening of the throttle valve 19, wherein of course the basic degree of vacuum advancing in idling operation is additionally incorporated. When the throttle valve 19 is opened very wide, both the first and the second vacuum ports 18 and 23 are exposed to substantially atmospheric pressure. In such an operating condition, therefore, the diaphragms are returned to their left end positions by the compression coil springs 13 and 14 so as to cancel the vacuum advancing.

When atmospheric pressure has lowered below a predetermined value in high altitude operation, so that the valve element 42 closes the valve port 41 in accordance with expansion of the elastic metal bellows 40, the chamber 31 of the ON/OFF valve 25 is supplied with intake vacuum through the second vacuum port 23 and the passages 22, 36, and 34 including the check valve 35, and the highest vacuum which appears in the vacuum port 23 is held in the chamber 31 by the action of the check valve 35. By this highest vacuum the diaphragm 30 is shifted upward in the FIGURE against the action of the compression coil 33 so as resiliently to hold the valve element 28 against the valve port 27. The vacuum which appears in the second valve port 23 is also supplied to the second diaphragm chamber 9 of the vacuum advancer and the second chamber 32 of the ON/OFF valve 25 through the check valve 21. If the vacuum supplied to the chamber 32 is close to the highest vacuum held in the first chamber 31 within a predetermined value which corresponds to the spring force of the compression coil spring 33, the diaphragm 30 is driven downward in the FIGURE by the compression coil spring 33 so as to open the valve port 27. If the vacuum which appears in the vacuum port 23 and is supplied to the chamber 32 is smaller than the highest vacuum held in the chamber 31 beyond a predetermined value which corresponds to the spring force of the compression coil spring 33, the valve port 27 is maintained in the closed condition. Therefore, in the system consisting of the second diaphragm chamber 9 and the passage 20, which is the downstream side of the check valve 21 as seen from the vacuum port 23, is held a vacuum higher than a predetermined value which is slightly smaller than the highest vacuum which appears in the vacuum port 23, in idling operation as well as in load bearing operation. This basic vacuum advancing of ignition timing effected by the vacuum held in the diaphragm chamber 9 compensates for the reduction of combustion speed of fuel-air mixture in high altitude operation of the engine. The other vacuum operation system consisting of the first diaphragm chamber 8, the passage 16 and the advancer port 18 operates in the same manner as in the conventional vacuum advancing system dependent upon an advancer port in accordance with opening of the throttle valve 19 even in high altitude operation of the engine.

When the vehicle has come down from a high to a normal altitude through a predetermined limit altitude, the port 41 of the barometric valve 38 is opened so as to release the chamber 31 of the ON/OFF valve 25 to the atmosphere, whereby the port 27 is opened so as to release the vacuum held in the second diaphragm chamber 9. Then the device performs normal altitude operation such as explained above.

Although the invention has been shown and described with respect to a preferred embodiment thereof, it should be understood by those skilled in the art that various changes and omissions from the form and the detail thereof may be made therein without departing from the scope of the invention.

I claim:

1. In an engine having an intake passage and a throttle valve provided in said intake passage, an ignition timing control device comprising:

a vacuum advancer having first and second diaphragm chambers and adapted to advance ignition timing when at least one of said diaphragm chambers is supplied with vacuum;

a first vacuum port which is positioned at the upstream side of the throttle valve when it is substantially closed so as to effect idling operation of the engine and which is positioned at the downstream side of the throttle valve when it is opened beyond a predetermined opening;

a second vacuum port constantly positioned at the downstream side of the throttle valve;

a first passage means which connects said first vacuum port and said first diaphragm chamber;

a second passage means which connects said second vacuum port and said second diaphragm chamber;

a check valve provided in said second passage means and adapted to allow fluid to flow only from said second diaphragm chamber toward said second vacuum port;

an ON/OFF valve provided in said second passage means in parallel with said check valve; and a barometric control means which controls said ON/OFF valve opening said ON/OFF valve when atmospheric pressure is at or above a predetermined value and tending to close said ON/OFF valve when atmospheric pressure is below the predetermined value.

2. The device of claim 1, wherein said ON/OFF valve is a diaphragm operated valve having a diaphragm, a diaphragm chamber provided on one side of said diaphragm, a valve port, and a valve element which is driven by said diaphragm and controls said valve port so as to open said valve port when said diaphragm chamber is supplied with substantially atmospheric pressure and so as to close said valve port when said diaphragm chamber is supplied with vacuum, and wherein said barometric control means comprises a vacuum passage which connects said diaphragm chamber of said ON/OFF valve to said second vacuum port, a check valve provided at a middle portion of said vacuum passage so as to allow fluid to flow only from said diaphragm chamber towards said second vacuum port, and a barometric valve which opens a middle portion of said vacuum passage located between said diaphragm chamber and said check valve to the atmosphere when atmospheric pressure is at or above said predetermined value.

3. The device of claim 2, wherein said ON/OFF valve further comprises a second diaphragm chamber provided on the other side of said diaphragm as opposed to the first-mentioned diaphragm chamber with interposition of said diaphragm and a spring which biases said diaphragm from the first-mentioned diaphragm chamber towards said second diaphragm chamber, wherein said second diaphragm chamber of said ON/OFF valve is connected with said second diaphragm chamber of said vacuum advancer.

4. The device of claim 2 or 3, wherein said barometric valve comprises a valve port which, when opened, opens said diaphragm chamber provided on the one side of said diaphragm, i.e., said first-mentioned diaphragm chamber of said ON/OFF valve, to the atmosphere, a valve element which selectively closes said valve port, and an elastic metal bellows which supports said valve element so as to drive it against said valve port when it is expanded due to reduction of atmospheric pressure.

5. In an engine having an intake passage and a throttle valve provided in said intake passage, an ignition timing control device, comprising:

a vacuum advancer having first and second diaphragm chambers and adapted to advance ignition timing when at least one of said diaphragm chambers is supplied with vacuum;

a first vacuum port which is positioned at the upstream side of the throttle valve when it is substantially closed so as to effect idling operation of the engine and which is positioned at the downstream side of the throttle valve when it is opened beyond a predetermined opening;

a second vacuum port constantly positioned at the downstream side of the throttle valve;

a first passage means which connects said first vacuum port and said first diaphragm chamber;

a second passage means which connects said second vacuum port and said second diaphragm chamber;

a check valve provided is said second passage means and adapted to allow fluid to flow only from said second diaphragm chamber toward said second vacuum port;

a diaphragm-operated ON/OFF valve provided in said second passage means in parallel with said check valve, and having a diaphragm, a first diaphragm chamber provided on one side of said diaphragm, a second diaphragm chamber provided on the other side of said diaphragm as opposed to the first diaphragm chamber with interposition of said diaphragm, a spring which biases said diaphragm from the first diaphragm chamber towards said second diaphragm chamber, said second diaphragm chamber being connected with said second diaphragm chamber of said vacuum advancer, a valve port, and a valve element which is driven by said diaphragm and controls said valve port so as to open said valve port when said first diaphragm chamber is supplied with substantially atmospheric pressure and so as to close said valve port when said first diaphragm chamber is supplied with vacuum;

a barometric control means comprising a valve port which, when opened, opens said first diaphragm chamber of said ON/OFF valve to the atmosphere, a valve element which selectively closes said valve port, and an elastic metal bellows which supports said valve element so as to drive it against said valve port when it is expanded due to reduction of atmospheric pressure, opening said ON/OFF valve when atmospheric pressure is at or above a predetermined value and tending to close said ON/OFF valve when atmospheric pressure is below the predetermined value.

* * * * *